US010234102B2

(12) United States Patent
Saito

(10) Patent No.: US 10,234,102 B2
(45) Date of Patent: Mar. 19, 2019

(54) ILLUMINATING INSTRUMENT

(71) Applicant: FACTORY INC., Tokyo (JP)

(72) Inventor: Tetsuro Saito, Tokyo (JP)

(73) Assignee: FACTORY INC., Tokyo (JP)

( * ) Notice: Subject to any disclaimer, the term of this patent is extended or adjusted under 35 U.S.C. 154(b) by 595 days.

(21) Appl. No.: 14/765,573

(22) PCT Filed: Aug. 9, 2013

(86) PCT No.: PCT/JP2013/004809
§ 371 (c)(1),
(2) Date: Sep. 27, 2015

(87) PCT Pub. No.: WO2014/125526
PCT Pub. Date: Aug. 21, 2014

(65) Prior Publication Data

US 2016/0025301 A1 Jan. 28, 2016

(30) Foreign Application Priority Data

Feb. 14, 2013 (JP) ..... 2013-026547

(51) Int. Cl.
*F21V 7/00* (2006.01)
*E04F 19/04* (2006.01)
(Continued)

(52) U.S. Cl.
CPC ..... *F21V 7/0041* (2013.01); *E04F 19/04* (2013.01); *F21S 8/037* (2013.01); *F21V 5/02* (2013.01);
(Continued)

(58) Field of Classification Search
CPC ..... F21V 7/0041; F21V 5/02; F21V 7/0008; F21V 13/04; F21V 33/0012;
(Continued)

(56) References Cited

U.S. PATENT DOCUMENTS 2,415,436 A * 2/1947 Maris ..... G01L 5/14 250/225
7,938,560 B2 * 5/2011 Hsu ..... F21V 7/0016 362/243
(Continued)

FOREIGN PATENT DOCUMENTS

JP 1990-98773 8/1990
JP 2002-276145 A 9/2002
(Continued)

*Primary Examiner* — Anh T Mai
*Assistant Examiner* — Jessica M Apenteng
(74) *Attorney, Agent, or Firm* — Im IP Law; C. Andrew Im; Chai Im

(57) ABSTRACT

A lighting fixture varies a beam angle of light emitted by a light source and a beam angle of light to the exterior to provide excellent visual effect by indirect lighting, high in serviceability and safety, and applicable to a wide range of purposes. The lighting fixture comprises a lighting fixture body of substantially L-shaped cross-section, a light source constituting a light radiation unit, a first reflector, a second reflector, and an opening constituting an illumination port. The light source is installed at an innermost center region of the vertical lightguide section to face into the vertical lightguide section. The first reflector is installed obliquely near one corner of the vertical lightguide section and the lateral lightguide section. The second reflector is obliquely installed near an endmost corner of the lateral lightguide section to face the first reflector.

12 Claims, 4 Drawing Sheets

(51) Int. Cl.

| | |
|---|---|
| ***F21V 33/00*** | (2006.01) |
| ***F21S 8/00*** | (2006.01) |
| ***F21V 5/02*** | (2006.01) |
| ***F21V 13/04*** | (2006.01) |
| *F21S 8/02* | (2006.01) |
| *F21W 131/301* | (2006.01) |
| *F21Y 115/10* | (2016.01) |

(52) U.S. Cl.
CPC ..... *F21V 7/0008* (2013.01); *F21V 13/04* (2013.01); *F21V 33/006* (2013.01); *F21V 33/0012* (2013.01); *F21S 8/02* (2013.01); *F21W 2131/301* (2013.01); *F21Y 2115/10* (2016.08)

(58) Field of Classification Search
CPC ..... F21V 33/006; E04F 19/04; F21S 8/037; F21S 8/02; F21Y 2115/10; F21W 2131/301
USPC ..... 362/300
See application file for complete search history.

(56) References Cited

U.S. PATENT DOCUMENTS

| | | | | |
|---|---|---|---|---|
| 2008/0123338 | A1 | 5/2008 | Kokado | |
| 2013/0279190 | A1* | 10/2013 | Huang ..... | G02B 6/4298 362/602 |

FOREIGN PATENT DOCUMENTS

| | | | |
|---|---|---|---|
| JP | 2006-79877 | A | 3/2006 |
| JP | 2007-299611 | A | 11/2007 |
| JP | 2008-135219 | A | 6/2008 |
| JP | 2010-192388 | A | 9/2010 |
| JP | 2011-003547 | A | 1/2011 |

* cited by examiner

ILLUMINATING INSTRUMENT

RELATED APPLICATIONS

This application is a § 371 application from PCT/JP2013/004809 filed Aug. 9, 2013, which claims priority from Japanese Patent Application No. 2013-026547 filed Feb. 14, 2013, each of which is herein incorporated by reference in its entirety.

TECHNICAL FIELD

The present invention relates to a lighting fixture to be embedded in a side wall of a building, particularly to a lighting fixture that utilizes multiple reflection units capable of reflecting light to change beam angle of light emitted by a light source and beam angle of guided light, thereby achieving high light source serviceability and safety, enabling application to a wide range of purposes, and also enabling indirect lighting excellent in visual effect.

BACKGROUND OF THE INVENTION

Many kinds of lighting fixture are known and ones of various shapes and structures are used in accordance with their purpose. And among these, some illuminate objects indirectly rather than by directly radiated light, and these include lighting fixtures of various structures that enable radiation in every direction and installation at any location, and also offer outstanding visual effect.

An ordinary lighting fixture is primarily intended for installation in a space for directly illuminating a subject and giving it a brighter appearance. However, lighting fixtures also exist that by adopting a structure differing from the ordinary lighting fixture in terms of place installed, radiating direction and radiation method, are capable of diffusing light uniformly within a space and of not only lighting the space but also rendering spatial visual effects.

For example, Japanese Patent Publication (A) No. 2010-192388 teaches a technical concept relating to a lighting fixture capable of regulating light distribution by also radiating light in many directions outside an LED light-emitting direction, which lighting fixture radiates some light emitted in one direction from an LED light source unit through a half-mirror member and out from one light outlet opening and radiates light reflected by the half-mirror member through another light outlet opening, thereby radiating light in multiple directions.

In the case of installing the so-devised lighting fixture on a side wall of building or the like, light distribution can be regulated by radiating light in multiple directions even when using an LED of high directivity as a light source. However, when the lighting fixture is embedded in a wall or floor for use, problems arise because light distribution becomes difficult to regulate. Another problem is that serviceability is not taken into account, so that light source replacement and other maintenance work become difficult in the case of wall- or floor-embedded installation.

Japanese Patent Publication (A) No. 2011-3547 teaches a technical concept that is an illuminating apparatus for a building capable of effectively dissipating heat produced by an LED light source and preventing the dissipated heat from increasing temperature of the illuminated space, which is installed in a baseboard region between a floor and an inner wall region to light a room by reflecting an illuminating beam from an LED light source, store heat discharged from the LED light source in a heat storage section, and then dissipate the heat from a heat dissipating section.

The so-devised illuminating apparatus can ensure safe use by dissipating generated heat, but it fails to offer adequate convenience from the viewpoint of light source maintenance (repair/replacement). Moreover, it is not made for use in a condition embedded under a floor and by structure shines light directly onto room occupants, so that also it has a drawback in not being able to produce an effect of softly lighting the room interior.

An embedded lighting fixture requires good safety and serviceability, as well as functionality for adequately achieving performance as a lighting fixture.

Therefore, a need has been felt for the development of an easy-to-use lighting fixture of not overly complicated structure, that is safe, excellent in serviceability and usable in any type of building.

PRIOR ART DOCUMENTS

Patent Documents

Patent Document 1:
Japanese Patent Publication (A) No. 2010-192388
Patent Document 2
Japanese Patent Publication (A) No. 2011-3547

OBJECT AND SUMMARY OF THE INVENTION

Problems to be Overcome by the Invention

The present invention provides a lighting fixture for solving the foregoing issues, which is a lighting fixture that performs indirect lighting and is also excellent in visual effect, and which, particularly by utilizing a reflection unit comprising multiple reflectors capable of reflecting light to change beam angle of light emitted by a light source and beam angle of light to outside, achieves high serviceability and safety of the light source and enables application to a wide range of purposes.

Means for Solving the Problem

In order to achieve the aforesaid object, the lighting fixture according to the present invention is a lighting fixture embedded in a side wall of a building to radiate light toward a space inside and outside a room while avoiding direct lighting, which lighting fixture comprises a lighting fixture body of substantially L-shaped cross-section constituted of a vertical lightguide section and a lateral lightguide section, a light source constituting a light radiation unit, a first reflector for reflecting light radiated from the light source, a second reflector for further reflecting light reflected by the first reflector to guide it out to illuminate the space inside and outside the room external of the lighting fixture body, and an opening constituting an illumination port formed near a wall surface where the second reflector is installed, in which configuration the light source is installed at an innermost center region of the vertical lightguide section to face into the vertical lightguide section so that light radiated from the light source impinges on the first reflector to be reflected symmetrically to an angle of incidence and impinge on the second reflector and further reflected from the second reflector to be guided from the illumination port into the space inside and outside the room, the first reflector is installed obliquely near one corner of the vertical lightguide section and the lateral lightguide section to receive light radiated from the light source and reflect light toward the second reflector, and the second reflector is obliquely installed near an endmost corner of the lateral lightguide section to face the first reflector so as to receive light reflected from the first reflector and guide it out to the illumination port by reflection.

Moreover, the lateral lightguide section is configured to comprise a trapezoidal prism or right-angle prism constituted of a translucent prismatic body through which prismatic body light radiated from the light source is guided, opposite ends of the prismatic body in the longitudinal direction passing the radiated light each being cut as a face inwardly inclined at an angle of 45 degrees in parallel toward the inside in the longitudinal direction to establish the opposite obliquely cut faces as the first reflector and the second reflector.

In addition, the prismatic body formed with the obliquely cut faces can also be configured to have a cross-section of inverted trapezoidal shape or a cross-section of inverted triangular shape.

In a further configuration, the first reflector and the second reflector comprise plate-like members constituting a first reflector plate and a second reflector plate, the first reflector plate is installed obliquely near one corner of the vertical lightguide section and the lateral lightguide section to receive light radiated from the light source and reflect light toward the second reflector plate, and the second reflector plate is obliquely installed at an endmost corner of the lateral lightguide section opposing the first reflector plate to receive light reflected from the first reflector plate and guide it out to the illumination port by reflection, whereby light radiated from the light source impinges on the first reflector plate to be reflected symmetrically to an angle of incidence and impinge on the second reflector plate and further reflected from the second reflector plate to be guided from the illumination port into the space inside and outside the room.

Further, the light source comprises a single LED or multiple LEDs.

In addition, the configuration is also one that installs the first reflector and the second reflector constituted of the plate-like members in the corners to be variable in angle in order to establish arbitrary beam angles.

Effect of the Invention

Being configured in the foregoing manner, the present invention offers the following effects.

1. Since the lighting fixture body is constituted in a substantially L-shaped cross-sectional shape by the vertical lightguide section and the lateral lightguide section, it can be installed in a baseboard region abutting a floor and a wall of a building. Further, owing to the adoption of a configuration by which a light beam from the light source is shined into and outside a room by means of the first reflector and the second reflector, the location of the light source can be defined at a position higher than the floor surface, so that replaceability/serviceability are enhanced, the underfloor region becomes a structure embedding only the reflectors, and an embedded underfloor lighting fixture can be realized that minimizes floor recessing depth. In addition, as the beam advances via the reflectors, the light source is unaffected even if condensation or the like occurs at the light radiation unit, so that light can be continuously radiated and risk of electrical shorting due to moisture can be reduced.

2. Since the lateral lightguide section is constituted of a trapezoidal prism or a right-angle prism that is a translucent prismatic body, the beam transmits through the prismatic body to be reflected by the prism end faces cut obliquely at an angle of 45 degrees, thereby preventing entry of foreign matter into the lateral lightguide section and enabling reflection and passage of the beam through a solid body unaffected even in an environment susceptible to invasion of moisture into the lateral lightguide section, such as when inundated.

3. Since the prismatic body is constituted to have a cross-section of inverted trapezoidal shape or cross-section of inverted triangular shape formed to have an oblique cross-section, it functions as a prism capable of achieving efficient light reflection.

4. Since the first reflector and the aforesaid second reflector comprise the first reflector plate and the second reflector plate constituted of plate-like members, light radiated from the light source is radiated into and outside a room via the first reflector plate and the second reflector plate by a structure that can be formed by installing simple plate members without use of a prismatic body (prism), while simultaneously enabling light radiation with the light source being unaffected by any moisture condensation or the like along the optical path and also reducing risk of electrical shorting due to moisture.

5. Since the light source comprises a single or multiple LEDs, light can be radiated stably over a long period of time and adequate illuminance is ensured even for indirect lighting.

6. Since the first reflector plate and the second reflector plate are structured to be rotatably installed in corners formed by the vertical lightguide section and lateral lightguide section of the lighting fixture body, beam angle can be arbitrarily defined in accordance with purpose while avoiding direct lighting.

DETAILED DESCRIPTION OF THE EMBODIMENTS

Figure 1:
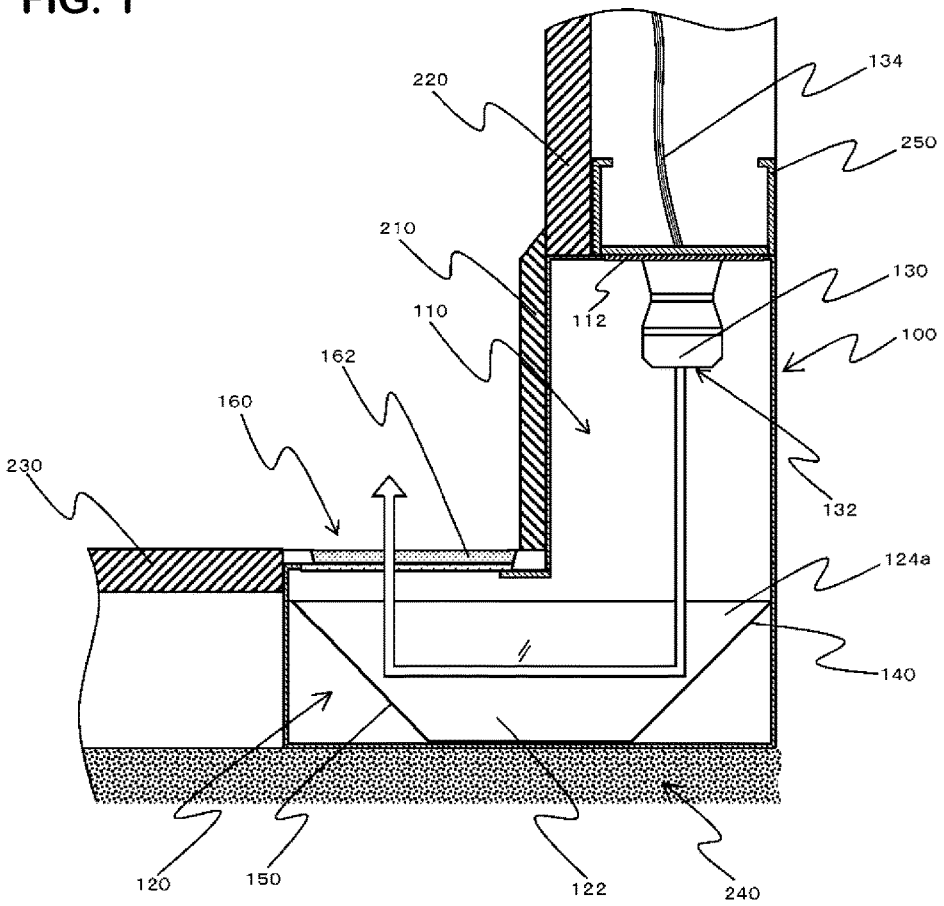
FIG. 1 is a side sectional view of a lighting fixture according to the present invention, which uses a trapezoidal prism.
Figure 2:
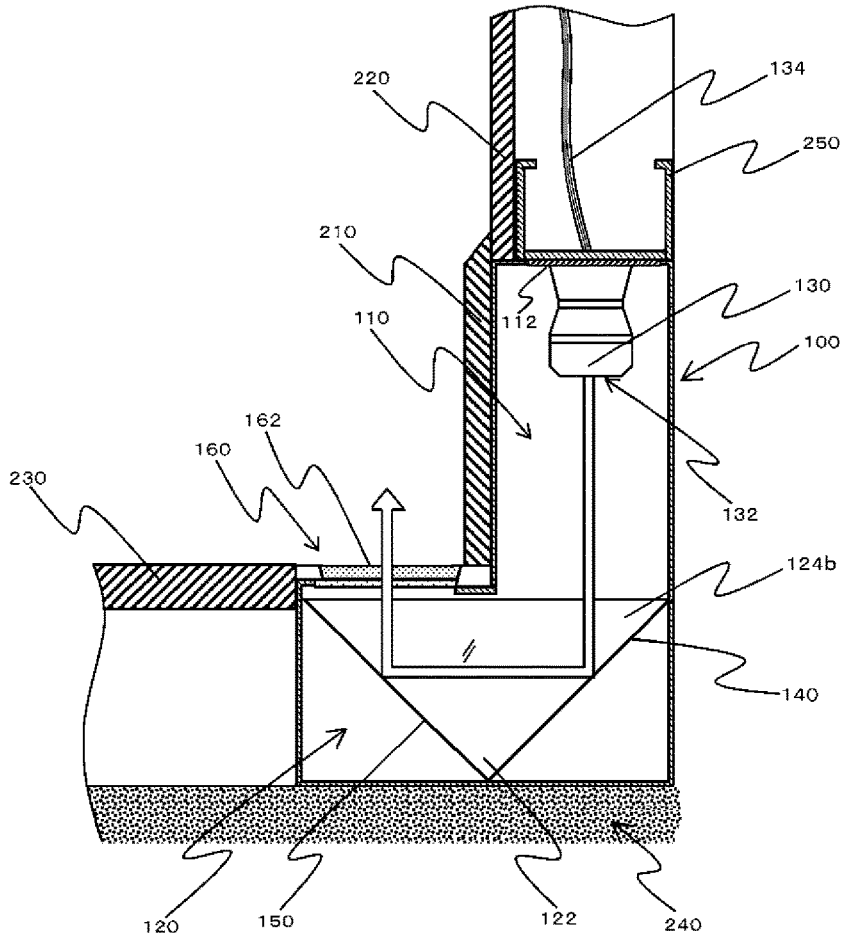
FIG. 2 is a side sectional view of a lighting fixture using a right-angle prism.
Figure 3:
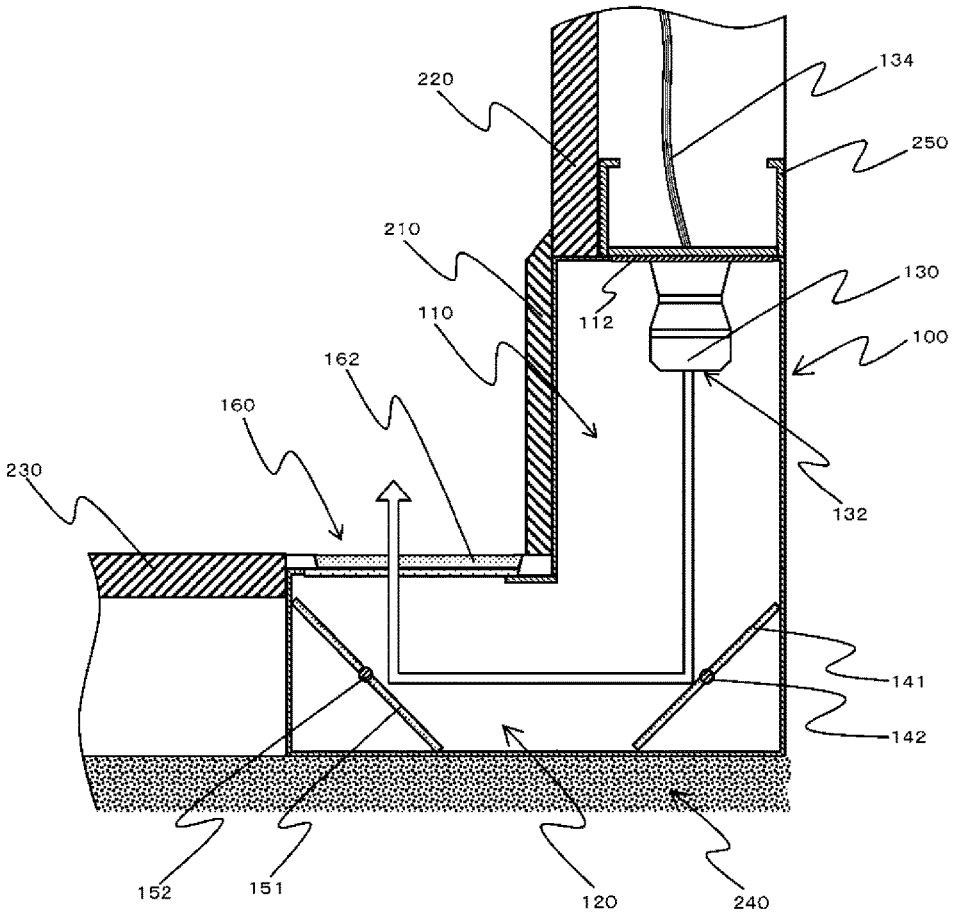
FIG. 3 is a side sectional view of a lighting fixture using reflectors that are plate-like members.
Figure 4:
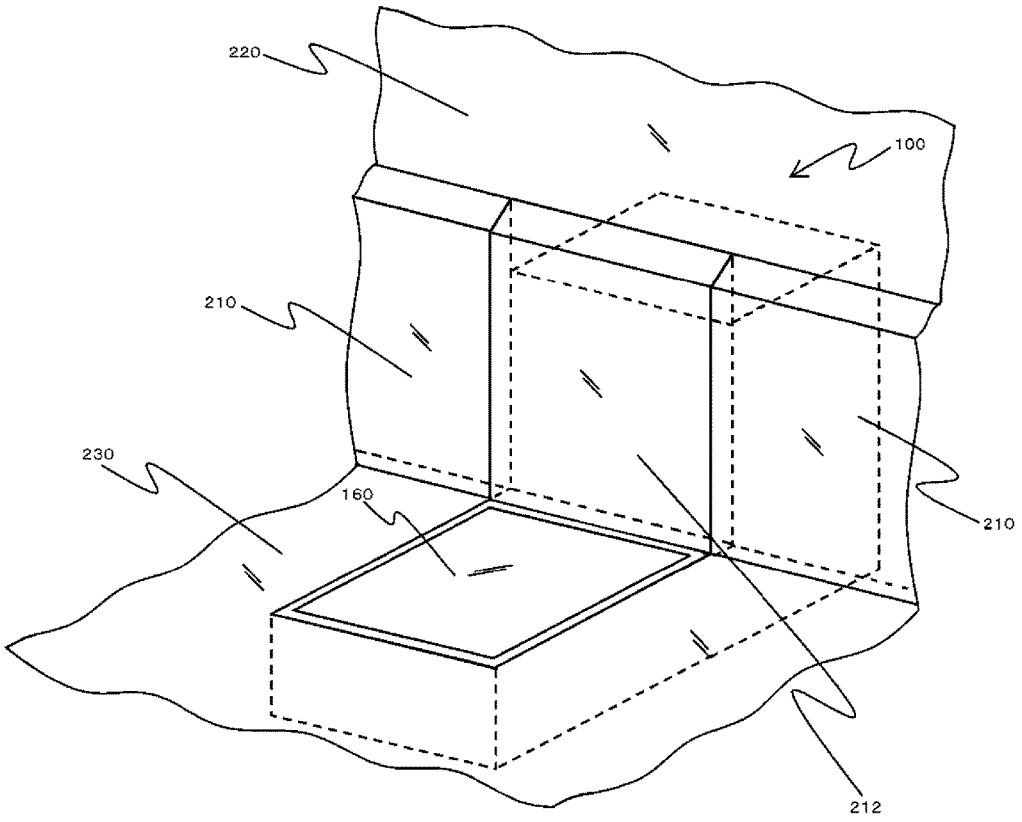
FIG. 4 is a perspective viewing showing a lighting fixture in an installed state.

The lighting fixture according to the present invention is explained in detail below based on embodiments shown in the drawings. FIG. 1 is a side sectional view of a lighting fixture according to the present invention, which uses a trapezoidal prism, and FIG. 2 is a side sectional view of a lighting fixture using a right-angle prism. FIG. 3 is a side sectional view of a lighting fixture using reflectors that are plate-like members, and FIG. 4 is a perspective viewing showing a lighting fixture in an installed state.

The lighting fixture according the present invention comprises a lighting fixture body 100 including a vertical lightguide section 110 and a lateral lightguide section 120, a light radiation unit 130, a first reflector 140, a second reflector 150, and an illumination port 160, wherein a light beam emitted by a light source is reflected by multiple reflectors to change the beam direction, thus realizing a safe and easy-to-use lighting fixture of enhanced serviceability, including light source replaceability, that avoids direct lighting.

The lighting fixture according to the present invention is embedded at a baseboard region in a building to run along a wall surface and a floor surface of the building, and is a lighting fixture for shining light toward a space inside and outside a room so as to avoid direct lighting, for the purpose of creating a relaxed atmosphere and protecting the eyes. As shown in FIGS. 1 to 3, the lighting fixture body 100 is an L-shaped case comprising the vertical lightguide section 110 and the lateral lightguide section 120.

The vertical lightguide section 110 is a vertically long member for guiding light from the light radiation unit 130 vertically and extends vertically along a surface of a building wall 220. The lateral lightguide section 120 is a horizontally long member for guiding light from the light radiation unit 130 horizontally and extends horizontally away from the wall 220 to run along a surface of a floor 230 of the building.

As the lighting fixture body 100 is embedded in a baseboard region of the building, it preferably made of a strong material. Although plastic or other synthetic resin is used as the material in the present embodiment, the material is not limited to these and a structure made of, for example, epoxy resin or a metal such as aluminum or stainless steel is also acceptable.

The light radiation unit 130 is a light source for transmitting a light beam from the lighting fixture body 100, and, as shown in FIGS. 1 to 3, it is hung from an upper end piece 112 constituting an innermost center region of the vertical lightguide section 110 to face downward into the vertical lightguide section 110. A power cable 134 connected to the light radiation unit 130 is wired from the upper end piece 112 to outside the lighting fixture body 100 and passes through the wall 220 of the building to connect to a power source (not shown). Owing to this configuration, the light source comes to be installed at a location above the surface of the floor 230, so that replacement, inspection and other maintenance work necessitated by wire breakage or light source failure becomes very easy. Further, no need for underfloor wiring arises, so that troublesome wiring is eliminated, wiring cost is reduced, and the wiring can be easily modified after installation.

The upper end piece 112 of the vertical lightguide section 110 can be configured like a detachable or openable cover. This enables easy removal of the light radiation unit 130 from the upper end piece 112. Namely, if the light radiation unit 130 should malfunction, it can be taken out for light source replacement or other maintenance simply by detaching the upper end piece 112 of the vertical lightguide section 110, without removing the case of the lighting fixture body 100, so that a lighting fixture excellent in serviceability can be provided.

The first reflector 140 and the second reflector 150 are installed in the lateral lightguide section 120. The first reflector 140 has material properties and a shape enabling reflection of light so as to reflect a beam emitted from the light radiation unit 130 toward the second reflector 150, and, as shown in FIGS. 1 to 3, the first reflector 140 is installed obliquely in one corner of the vertical lightguide section 110 and the lateral lightguide section 120 to receive light radiated from the light radiation unit 130 and reflect a beam toward the second reflector 150.

Moreover, the second reflector 150 is a member for further reflecting the beam reflected by the first reflector 140 to guide it out to illuminate the space inside and outside the room external of the lighting fixture body 100, and is constituted to have material properties and a shape enabling reflection of light. As for the second reflector 150, as shown in FIGS. 1 to 3, the second reflector 150 is obliquely installed near an endmost corner of the lateral lightguide section 120 to face the first reflector 140, receive the beam reflected from the first reflector 140, and further guide the beam out to the illumination port 160 by reflection.

The first reflector 140 and the second reflector 150 in this first embodiment are, as elaborated later, configured by mounting a trapezoidal prism 124*a* or a right-angle prism 124*b* constituted of a prismatic body in the lateral lightguide section 120 and employing opposite oblique faces of the prism as the first reflector and the second reflector. By this, light can transmit through the lighting fixture body 100 while being effectively reflected to change direction by 180 degrees so as to be guided into and light the room within and without.

The illumination port 160 is an opening for leading light reflected and guided through the lighting fixture body 100 to the exterior of the lighting fixture body 100 and is provided near a wall surface where the second reflector 150 is installed. The illumination port 160 is arranged in parallel and flush with the floor 230. The present embodiment is configured to emit light upward from here.

A light-transmissive panel 162 is fitted in the illumination port 160 to hermetically seal the lighting fixture body 100 in a light transmitting condition. This prevents invasion of water, dust and the like into the lighting fixture body 100, enables aesthetic enhancement, and by lying flush with the floor 230, can protect against injury by stumbling over or wedging in the port region.

Although transparent or translucent glass is used as the material of the light-transmissive panel 162 in this embodiment, this is not a limitation and use of an acrylic resin or the like is also possible. Moreover, the transparent glass used in the present embodiment can be processed by coloring and/or matting to render various lighting effects, and the fact that is very easy to exchange, suggests the possibility of changing it to match the needs parties and other occasions.

Owing to the aforesaid configuration, a beam emitted from the light radiation unit 130 impinges on the first reflector 140 to be reflected symmetrically to its angle of incidence and impinge on the second reflector 150. The beam is further reflected from the second reflector 150 to guide the beam radiated from the light radiation unit 130 through the illumination port 160 into the space inside and outside the room. Thanks to this structure, the light radiation unit 130 does not come into direct contact with moisture even if dew concentration or breakage should result in invasion of moisture into the lighting fixture body 100, whereby risk of equipment breakage and shorting can be avoided and a highly safe lighting fixture can be installed without deep embedment under the floor. Outdoor installation is also possible.

The aforesaid structure of the lighting fixture body 100 according to present invention makes installation easy. Specifically, the conventional embedded lighting fixture has a problem in that installation in a building structure whose floor case is shallow is impossible because the light radiation unit 130 is itself embedded under the floor, while in contrast the lighting fixture body 100 according to the present invention requires only that the lateral lightguide section 120 comprising the multiple reflectors be embedded under the floor, so that the dimensions of the underfloor embedment can be shallow, thus making installation much easier and cheaper than heretofore. Moreover, installation when renovating also becomes easy because the depth of underfloor recessing can be similarly minimized in such a case.

As shown in FIGS. 1 and 2, the first reflector 140 and the second reflector 150 are configured by the trapezoidal prism 124*a* or the right-angle prism 124*b* constituted of a prismatic body 122 mounted in the lateral lightguide section 120, and opposite oblique faces of the prism are employed as the first reflector 149 and the second reflector 150. In other words, the prismatic body 122, whose interior is translucent, is set in the lateral lightguide section 120 and the beam radiated from the light source is transmissively conducted through the prismatic body 122. A configuration is adopted wherein opposite ends of the prismatic body 122 in the longitudinal direction through which the radiated light passes are each in a cut shape of a face inwardly inclined at an angle of 45 degrees in parallel toward the inside in the longitudinal direction, whereby the opposite obliquely cut faces define the first reflector and the second reflector.

Owing to this configuration and characteristics of the prism, light is transmissively conducted through the prismatic body 122 (through the prism) while being twice reflected 90 degrees in direction and radiated to the exterior. As the prism is a solid body, danger of invasion of contaminants into the light-guiding path is eliminated, and stable radiation of light can be continued in any environment. Moreover, as the light-guiding path is constituted by the prism, reflection angle deviation and beam transmission failure can be avoided and stable beam transmission resistant to environmental effects can be realized.

The prismatic body 122 is a translucent member that can conceivably use glass or crystal as its material, but is not limited thereto, and a prism made of acrylic resin or the like is also usable. Moreover, while the prismatic body 122 is colorless and transparent in the present embodiment, this is not a limitation, and use in a translucent state but colored red, blue, green or the like is also possible. As a result, spatial rendering of various images of outstanding visual effect can be achieved.

As shown in FIGS. 1 and 2, the prismatic body 122 is formed with the obliquely cut faces and configured to have a cross-section of inverted trapezoidal shape or a cross-section of inverted triangular shape. In other words, by forming the prismatic body 122 to have a cross-section of inverted trapezoidal shape as shown in FIG. 1 (the trapezoidal prism 124*a*), the length of the lateral lightguide section 120 can be ensured. This makes it possible to expand the area of the illumination port 160, move the location of the illumination port 160 away from the wall, and accommodate the vertical lightguide section 110 inward of the wall surface utilizing the thick wall 220.

Moreover, by forming the prismatic body 122 to have a cross-section of inverted triangular shape as shown in FIG. 2 (the right-angle prism 124*b*), a compact lighting fixture can be configured.

In a second embodiment of the present invention, the first reflector 140 and the second reflector 150 can be defined by a first reflector plate 141 and a second reflector plate 151 comprised of plate-like members. Specifically, in this structure, the first reflector plate 141 and the second reflector plate 151 are mounted in the lateral lightguide section 120. The first reflector plate 141 is a mirror-like member that reflects light radiated from the light radiation unit 130 toward the second reflector plate 151 and, as shown in FIG. 3, the first reflector plate 141 is installed obliquely in one corner of the vertical lightguide section 110 and lateral lightguide section 120 to receive light radiated from the light radiation unit 130 and reflect light in the direction of the second reflector plate 151.

Moreover, the second reflector plate 151 is a mirror-like member for further reflecting light reflected by the first reflector plate 141 and guiding it out to the space inside and outside the room that is located outside the lighting fixture body 100. Regarding the second reflector plate 151, as shown in FIG. 3, the second reflector plate 151 is obliquely installed at an endmost corner of the lateral lightguide section 120 opposing the first reflector plate 141 so as to receive light reflected from the first reflector plate 141 and guide it out to the illumination port 160 by further reflection.

Although for reflecting light, mirror-like members are used for the first reflector plate 141 and second reflector plate 151 in the present embodiment, this is not a limitation, and it is conceivable to lower illuminance of reflected light by, for example, smoking the surfaces. This makes it possible to regulate light led into the space inside and outside the room by softening it. In other words, a lighting fixture that performs indirect light illumination excellent in visual effect can be easily realized.

In the present embodiment, the light source of the light radiation unit 130 adopts a structure comprising a single LED or multiple LEDs 132. The high light beam directivity of the LED makes it suitable for a lighting fixture that utilizes a prism or multiple reflector plates as in the present invention. Additional LED advantages include adequate illuminance, excellent durability, and low power consumption. The LED(s) deployed in the light radiation unit 130 constituting the light source can be installed as a single LED or multiple LEDs, in accordance with the illuminance required by the application.

When the first reflector 140 and second reflector 150 are constituted of mirrors configured as plate-like members, a configuration can be adopted that installs the first reflector plate 141 and the second reflector plate 151 in corners of the lateral lightguide section 120 to be angularly variable. For example, as shown in FIG. 3, it is possible to provide the first reflector plate 141 with a first shaft 142 and the second reflector plate 151 with a second shaft 152 and to rotatably support the reflector plates in corners of the lateral lightguide section 120. This makes it possible to change the angle of the beam radiated by the light radiation unit 130 and the beam reflected from the first reflector plate 141, so that light can be directed from the illumination port 160 into the space inside and outside the room in any direction.

By embedding the lighting fixture according to the present invention inside the wall and under the floor at a baseboard 210 region where the wall 220 and floor 230 of the building intersect, as shown in FIG. 4, the lighting fixture can be used as an uplight. Moreover, as shown in FIGS. 1 to 3, the invention fixture can be mounted on a light-gauge stud (LGS) 250 and the power cable be passed through a gap near the light-gauge stud 250 and connected to a power source (not shown), thus saving the work of underfloor wiring and simplifying both installation and maintenance.

In addition, the floor 230 and illumination port 160 are configured as a level surface with no unevenness, and the vertical lightguide section 110 on the side of the illumination port 160 can be made the same size as and integral with the baseboard 210.

As shown in FIG. 4, the lighting fixture body 100 can be configured so that a panel member 212 integral with the baseboard 210 is joined to the vertical lightguide section 110 and the lighting fixture body 100 can be detached from the building. By such a configuration, the lighting fixture becomes one body with the baseboard at the time of installation, easy detachment becomes possible, an aesthetically superior lighting fixture can be realized, and easy installation with only moderate recessing of an existing floor is possible even at the time of building renovation.

In an embodiment of the lighting fixture of the present invention, installation is possible wherever the inside-outside wall 220 and floor 230 make contact, while it is also possible to install lighting fixtures in series. In other words, the configuration enables easy installation and also excellent serviceability, so that multiple lighting fixtures can be installed in a row even along a long wall so as to ensure adequate illuminance and thus provide a lighting fixture that creates a highly aesthetically pleasing space both within and without a room.

Another embodiment of the invention that installs the lighting fixture at places other than on the floor of a building or the like is also conceivable. For example, installation on a shelf or the like in a building is also possible, and use for highly aesthetic indirect lighting can be realized. Moreover, the direction of the lighting fixture body 100 installation can also be changed, so that installation at a ceiling region for shining light downward or horizontally is also possible. In all cases, installation is easy, and a lighting fixture with abundant aesthetic and serviceability features can be installed, additionally provided and modified.

EXPLANATION OF SYMBOLS

100 Lighting fixture body
110 Vertical lightguide section
112 Upper end piece
120 Lateral lightguide section
122 Prismatic body
124*a* Trapezoidal prism
124*b* Right-angle prism
130 Light radiation unit
132 LED
134 Power cable
140 First reflector
141 First reflector plate
142 First shaft
150 Second reflector
151 Second reflector plate
152 Second shaft
160 Illumination port
162 Light-transmissive panel
210 Baseboard
212 Panel member
220 Wall
230 Floor
240 Slab
250 Light-gauge stud

The invention claimed is:

1. A lighting fixture embedded in a side wall of a building to radiate light toward a space inside and outside a room while avoiding direct lighting, comprising:

a lighting fixture body of substantially L-shaped cross-section comprising a vertical lightguide section and a lateral lightguide section;

a light source comprising a light radiation unit;

a first reflector to reflect light radiated from the light source;

a second reflector to reflect and guide light reflected by the first reflector to illuminate the space inside and outside the room external of the lighting fixture body;

an opening comprising an illumination port formed near a wall surface having the second reflector installed thereon;

wherein the light source is installed at an innermost center region of the vertical lightguide section to face into the vertical lightguide section so that light radiated from the light source impinges on the first reflector to be reflected symmetrically to an angle of incidence and impinges on the second reflector to be further reflected from the second reflector and guided from the illumination port into the space inside and outside the room;

wherein the first reflector is installed obliquely near one corner of the vertical lightguide section and the lateral lightguide section to receive light radiated from the light source and to reflect light toward the second reflector;

wherein the second reflector is obliquely installed near an endmost corner of the lateral lightguide section to face the first reflector to receive light reflected from the first reflector and guide the light out to the illumination port by reflection;

wherein the lateral lightguide section comprises a trapezoidal prism or right-angle prism comprising a translucent prismatic body through which the light radiated from the light source is guided, opposite ends of the translucent prismatic body in a longitudinal direction passing the radiated light each being cut as a face inwardly inclined at an angle of 45 degrees in parallel toward inside in the longitudinal direction to establish opposite obliquely cut faces as the first reflector and the second reflector; and wherein the lateral lightguide section is configured to extend horizontally away from the side wall to run along a surface of a floor of the building.

2. The lighting fixture according to claim 1, wherein the translucent prismatic body formed with the obliquely cut faces is a prismatic body having a cross-section of inverted trapezoidal shape or a cross-section of inverted triangular shape.

3. The lighting fixture according to claim 1, wherein the first reflector and the second reflector comprise plate-like members comprising a first reflector plate and a second reflector plate; the first reflector plate is installed obliquely near one corner of the vertical lightguide section and the lateral lightguide section to receive light radiated from the light source and reflect light toward the second reflector plate; the second reflector plate is obliquely installed at an endmost corner of the lateral lightguide section opposing the first reflector plate to receive light reflected from the first reflector plate and guide the light out to the illumination port by reflection; and wherein the light radiated from the light source impinges on the first reflector plate to be reflected symmetrically to an angle of incidence and impinges on the second reflector plate to be further reflected from the second reflector plate and guided from the illumination port into the space inside and outside the room.

4. The lighting fixture according to claim 3, wherein the first reflector and the second reflector comprising the plate-like members are installed in the corners to be angularly variable to establish arbitrary beam angles.

5. The lighting fixture according to claim 1, wherein the light source comprises a single LED or multiple LEDs.

6. The lighting fixture according to claim 1, wherein the vertical lightguide section comprises a detachable or openable cover at the innermost center region.

7. A lighting fixture embedded in a side wall of a building to radiate light toward a space inside and outside a room while avoiding direct lighting, comprising:

a lighting fixture body of substantially L-shaped cross-section comprising a vertical lightguide section and a lateral lightguide section;

a light source comprising a light radiation unit;

a first reflector to reflect light radiated from the light source;

a second reflector to reflect and guide light reflected by the first reflector to illuminate the space inside and outside the room external of the lighting fixture body;

an opening comprising an illumination port formed near a wall surface having the second reflector installed thereon;

wherein the light source is installed at an innermost center region of the vertical lightguide section to face into the vertical lightguide section so that light radiated from the light source impinges on the first reflector to be reflected symmetrically to an angle of incidence and impinges on the second reflector to be further reflected from the second reflector and guided from the illumination port into the space inside and outside the room;

wherein the first reflector is installed obliquely near one corner of the vertical lightguide section and the lateral lightguide section to receive light radiated from the light source and to reflect light toward the second reflector;

wherein the second reflector is obliquely installed near an endmost corner of the lateral lightguide section to face the first reflector to receive light reflected from the first reflector and guide the light out to the illumination port by reflection;

wherein the lateral lightguide section comprises a trapezoidal prism or right-angle prism comprising a translucent prismatic body through which the light radiated from the light source is guided, opposite ends of the translucent prismatic body in a longitudinal direction passing the radiated light each being cut as a face inwardly inclined at an angle of 45 degrees in parallel toward inside in the longitudinal direction to establish opposite obliquely cut faces as the first reflector and the second reflector; and wherein the vertical lightguide section comprises a detachable or openable cover at the innermost center region.

8. The lighting fixture according to claim 7, wherein the translucent prismatic body formed with the obliquely cut faces is a prismatic body having a cross-section of inverted trapezoidal shape or a cross-section of inverted triangular shape.

9. The lighting fixture according to claim 7, wherein the first reflector and the second reflector comprise plate-like members comprising a first reflector plate and a second reflector plate; the first reflector plate is installed obliquely near one corner of the vertical lightguide section and the lateral lightguide section to receive light radiated from the light source and reflect light toward the second reflector plate; the second reflector plate is obliquely installed at an endmost corner of the lateral lightguide section opposing the first reflector plate to receive light reflected from the first reflector plate and guide the light out to the illumination port by reflection; and wherein the light radiated from the light source impinges on the first reflector plate to be reflected symmetrically to an angle of incidence and impinges on the second reflector plate to be further reflected from the second reflector plate and guided from the illumination port into the space inside and outside the room.

10. The lighting fixture according to claim 9, wherein the first reflector and the second reflector comprising the plate-like members are installed in the corners to be angularly variable to establish arbitrary beam angles.

11. The lighting fixture according to claim 7, wherein the light source comprises a single LED or multiple LEDs.

12. The lighting fixture according to claim 7, wherein the lateral lightguide section is configured to extend horizontally away from the side wall to run along a surface of a floor of the building.

* * * * *